US007392829B2

(12) United States Patent
Griffith

(10) Patent No.: US 7,392,829 B2
(45) Date of Patent: Jul. 1, 2008

(54) YARN CARRIER

(75) Inventor: John Dalton Griffith, Sunderland (GB)

(73) Assignee: Griffith Textile Machines Limited (GB)

( * ) Notice: Subject to any disclaimer, the term of this patent is extended or adjusted under 35 U.S.C. 154(b) by 32 days.

(21) Appl. No.: 11/361,211

(22) Filed: Feb. 24, 2006

(65) Prior Publication Data

US 2006/0196570 A1 Sep. 7, 2006

(30) Foreign Application Priority Data

Feb. 24, 2005 (GB) ..... 0503790.8

(51) Int. Cl.

| | |
|---|---|
| ***D03D 39/02*** | (2006.01) |
| ***D03D 47/20*** | (2006.01) |
| ***D03D 47/23*** | (2006.01) |
| *D03D 47/27* | (2006.01) |

(52) U.S. Cl. ..... 139/7 A; 139/447; 139/448; 139/7 B; 139/7 C

(58) Field of Classification Search ..... 139/2, 139/7 A, 7 C, 7 G, 447, 448
See application file for complete search history.

(56) References Cited

U.S. PATENT DOCUMENTS

| | | | | |
|---|---|---|---|---|
| 1,825,110 | A * | 9/1931 | Coyle | 139/7 A |
| 1,845,614 | A * | 2/1932 | Mason | 139/9 |
| 3,963,058 | A * | 6/1976 | Dewhirst | 139/2 |
| 5,143,125 | A * | 9/1992 | Tamatani et al. | 139/450 |
| 5,743,306 | A * | 4/1998 | Stewart et al. | 139/7 A |
| 6,220,307 | B1 * | 4/2001 | Griffith | 139/7 A |
| 6,289,938 | B1 * | 9/2001 | Dewispelaere | 139/7 A |
| 6,293,314 | B1 * | 9/2001 | Dewispelaere | 139/2 |
| 7,044,172 | B2 * | 5/2006 | Stewart | 139/7 A |
| 2003/0150505 | A1 * | 8/2003 | Burton | 139/7 A |

FOREIGN PATENT DOCUMENTS

| | | |
|---|---|---|
| GB | 186 788 A | 10/1922 |
| GB | 728 216 A | 4/1955 |
| GB | 1 075 082 | 6/1964 |
| GB | 1 203 717 A | 9/1970 |
| GB | 2 340 847 | 8/1998 |
| GB | 2 340 847 A | 3/2000 |
| GB | 2 387 853 A | 10/2003 |

* cited by examiner

*Primary Examiner*—Robert H Muromoto, Jr.
(74) *Attorney, Agent, or Firm*—Thomas J. Nikolai; Nikolai & Mersereau, P.A.

(57) ABSTRACT

A yarn carrier (30) for presenting a selected yarn (16) to a pair of gripper jaws (26,28). The yarn carrier (30) includes a yarn guide passageway (14) defining a path along which the selected yarn (16) is longitudinally guided. The passageway (14) has a yarn inlet end, a yarn outlet end and adjacent to the yarn outlet end yarn guides (32) to constrain the tail of the yarn ($Y_T$) against lateral deflection in a longitudinal direction of the yarn carrier (30). The yarn guides (32) are depressible on contact with open gripper jaws (26,28) to enable the gripper jaws (26,28) to grip the yarn tail ($Y_T$).

6 Claims, 3 Drawing Sheets

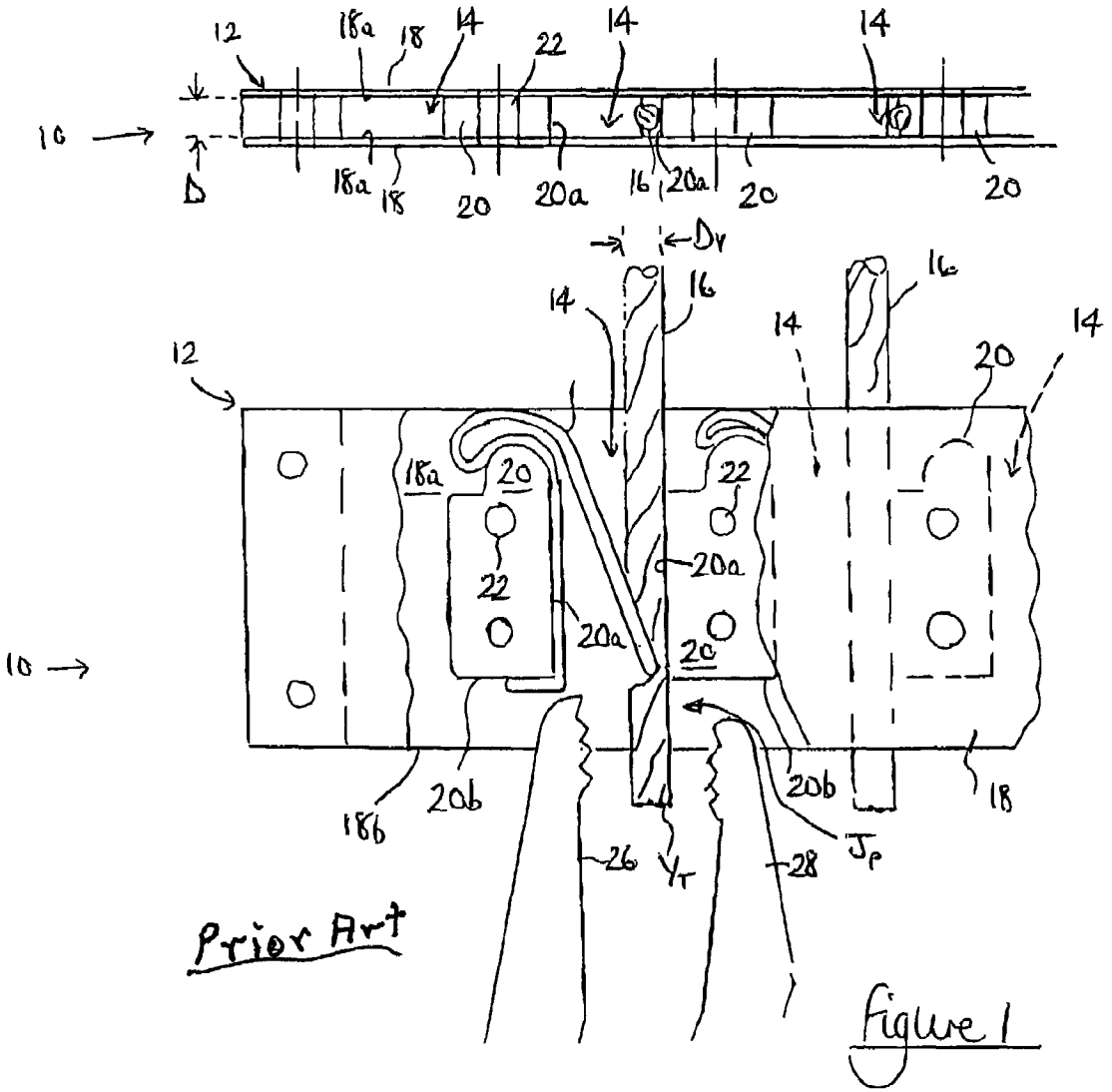
Figure 1
Prior Art
Figure 2
(Prior Art)
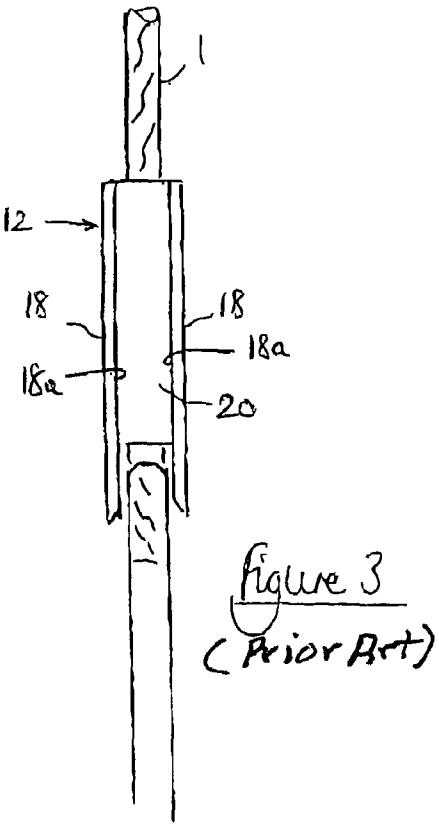
Figure 3
(Prior Art)

YARN CARRIER

BACKGROUND OF THE INVENTION

I. Field of the Invention

The present invention relates to a yarn carrier and, in particular, a yarn carrier for use in an Axminster gripper loom. The invention also relates to an Axminster gripper loom incorporating the yarn carrier, a method of holding a plurality of yarns for selective presentation to a pair of gripper jaws in an Axminster gripper loom and a method of weaving a carpet.

II. Discussion of the Prior Art

In Axminster weaving, pile yarn is held in a carrier. Different colors of pile yarn are held in different positions along the carrier, and the carrier is selectively moved along its axis to present a chosen color to a gripper. The gripper picks the protruding end of the yarn, and withdraws a length prior to cutting a tuft length and placing it in the carpet. The reliability of the pick up of the yarn is dependent on the consistency of the yarn. In circumstances where the yarn is curly or badly twisted, for example, the protruding end of the yarn may not lie straight. Consequently, the gripper may not be able to pick up the yarn or may only pick up the yarn in a loose and unreliable manner.

It is an object of this invention to improve the reliability of pick up, and provide a yarn carrier that enables a gripper to pick up a yarn regardless of whether the yarn lies straight.

It is a further object of the invention to provide a yarn carrier that holds yarn so that the yarn cannot be pulled back out of the yarn carrier.

SUMMARY OF THE INVENTION

According to one aspect of the present invention there is provided a yarn carrier for presenting a selected yarn to a pair of gripper jaws, the yarn carrier including a yarn guide passageway defining a path along which the selected yarn is longitudinally guided, the passageway having a yarn inlet end, a yarn outlet end and adjacent to the yarn outlet end, yarn guides to constrain the tail of the yarn against lateral deflection in a longitudinal direction of the yarn carrier, the yarn guides being depressible on contact with open gripper jaws to enable the gripper jaws to grip the yarn tail.

A plurality of such yarn carriers may be used in an Axminster gripper loom.

According to another aspect of the invention there is provided a method of holding a plurality of yarns for selective presentation to a pair of gripper jaws in an Axminster gripper loom comprising the steps of:

(i) inserting the yarns into yarn inlet ends of longitudinally spaced yarn guide passageways provided in a yarn carrier;
(ii) guiding the yarns along the respective yarn guide passageways to present tails of yarn at yarn outlet ends of the yarn guide passageways; and
(iii) constraining each of the tails of yarn against lateral deflection in a longitudinal direction of the yarn carrier.

Such a method of holding a plurality of yarns may be used in a method of weaving a carpet comprising the steps of (i) holding pluralities of yarns in a plurality of yarn carriers for selective presentation to pluralities of pairs of gripper jaws;
(ii) selectively moving each of the yarn carriers to present a chosen yarn to a respective pair of the gripper jaws;
(iii) operating each pair of gripper jaws to pick up the tail of the chosen yarn and withdraw a predetermined length of the chosen yarn from the respective yarn carrier;

(iv) cutting each of the chosen yarns such that each pair of gripper jaws holds a tuft of yarn;
(v) operating each pair of gripper jaws to transfer the tufts of yarn to weaving positions in a carpet; and
(vi) securing each tuft of yarn in position within the carpet by means of a weaving process.

DESCRIPTION OF THE DRAWINGS

An embodiment of the invention will now be described, by way of a non-limiting example, with reference to the accompanying drawings in which:

FIG. 1 shows a partial, broken away, side view of a conventional yarn carrier;

FIG. 2 is a plan view of the underside view of the carrier shown in FIG. 1;

FIG. 3 is an end view of the carrier shown in FIG. 1;

DESCRIPTION OF THE PREFERRED EMBODIMENT

Figure 5:
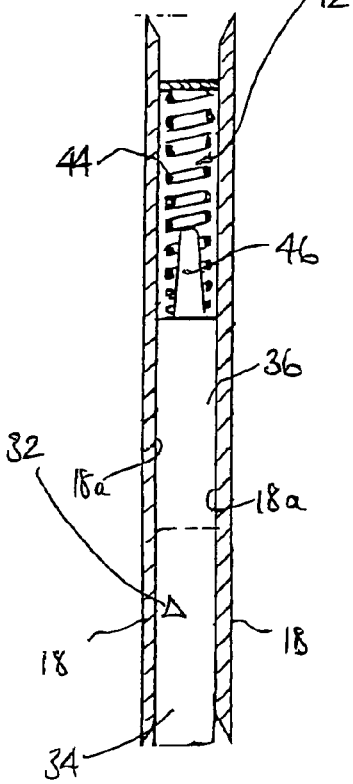
FIG. 5 shows a cross-sectional view along the line I-I of the yarn carrier shown in FIG. 4.

A conventional yarn carrier 10 is shown in FIGS. 1 to 3 and includes an elongate carrier body 12 longitudinally along which are spaced yarn guide passageways 14. In each passageway 14 there is located a yarn 16.

The body 12 of the yarn carrier 10 is made up of a pair of side plates 18 which are held, spaced apart, by a series of anvils 20. Rivets 22 pass through the anvils 20 and plates 18 in order to fixedly secure the side plates 18 and anvils 20 together.

Each passageway 14 is thereby defined by the opposed internal faces 18*a* of the plates 18 and the opposed side faces 20*a* of adjacent anvils 20.

A yarn brake 24, formed of a resilient spring material, is provided in each passageway 14 to ensure that the yarn 16 is only able to pass longitudinally in one direction and is held in place when not being drawn. As seen, the yarn brake 24 is mounted on one anvil 20 to extend across the passageway 14 to abuttingly engage the opposed side face 20*a* of the neighboring anvil 20.

The distance D between the internal faces 18*a* of plates 18 is substantially the same as the diameter $D_Y$ of the yarn 16. Consequently, the yarn 16 is constrained against lateral deflection in the widthwise direction of the carrier body 12.

The gripper associated with the yarn carrier 10 has a pair of gripper jaws 26,28 which operate (i) to pick up the tail of yarn $Y_T$ extending below the anvils 20, (ii) draw the yarn tail $Y_T$ downwardly by a predetermined distance, (iii) hold the yarn tail $Y_T$ in that position while a cutter severs the yarn tail $Y_T$ from the remainder of the yarn 16 to form a yarn tuft and (iv) transfers the yarn tuft for weaving into a carpet.

In order to facilitate registry between the gripper jaws 26,28 and the yarn tail $Y_T$ during the pick-up operation, the lower faces 20*b* of the anvils 20 are located inboard of the bottom side 18*b* of the plates 18 to define a jaw pick-up region $J_P$ into which the terminal ends of the gripper jaws 26,28 may pass (as shown in FIG. 1).

It will be appreciated however, that the provision of the jaw pick-up region $J_P$ by the absence of the anvils 20 means that the passageway 14 in the jaw pick-up region $J_P$ is open-sided in the longitudinal direction of the carrier body 12. Accordingly, prior to the gripper jaws 26,28 entering the jaw pick-up region $J_P$, the yarn tail $Y_T$ is constrained against lateral deflection in the widthwise direction of the carrier body 12 but is not constrained against lateral deflection in the longitudinal direction of the carrier body 12 (i.e. in the direction of closing of the gripper jaws 26,28).

When the gripper moves to pick up the yarn tail $Y_T$, the terminal ends of the gripper jaws 26,28 enter the passageway 14 beneath the anvils 20 and close to grip opposed sides of the yarn tail $Y_T$. When this operation takes place the yarn tail $Y_T$ is not constrained against lateral deflection in the longitudinal direction of the carrier body 12. Accordingly when the gripper jaws 26,28 close, the yarn tail $Y_T$ may be inclined in the longitudinal direction of the carrier body 12 and so fail to be gripped by the gripper jaws 26,28. Also, if the yarn 16 is a hairy yarn, or the yarn has not been cleanly severed, the protruding hairs or strands may interfere with the gripper jaws 26,28 during the closing operation to deflect the yarn tail $Y_T$ in the longitudinal direction of the carrier 12 and away from the closing gripper jaws 26,28. This could cause the gripper jaws 26,28 to fail to pick up the yarn tail $Y_T$.

The carrier according to the invention differs from the conventional carrier, as exemplified in FIG. 1, in that it is adapted to also constrain the yarn tail $Y_T$ against lateral deflection in the longitudinal direction of the carrier body 12.

Figure 4:
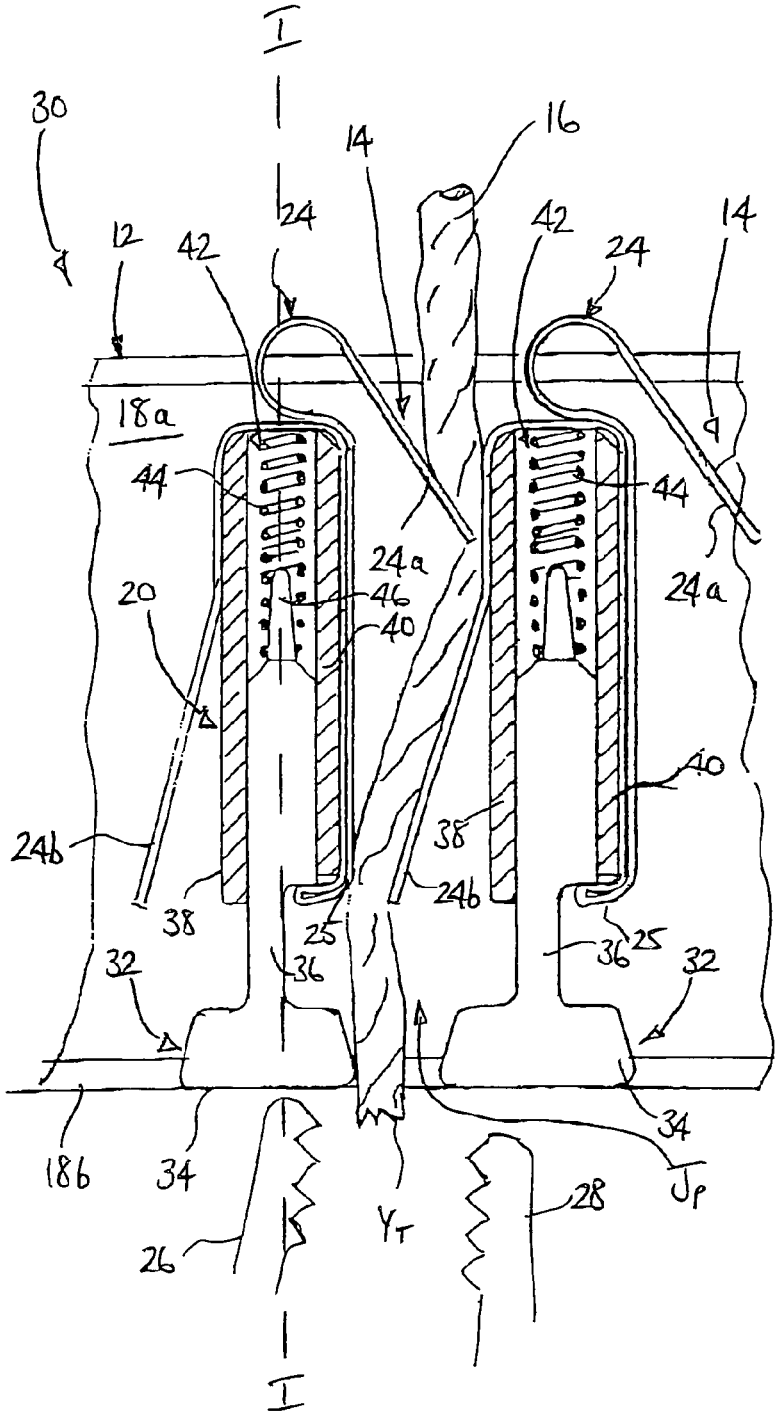
FIG. 4 shows a partial, broken away, side view of a yarn carrier according to an embodiment of the invention.

A yarn carrier 30 according to an embodiment of the invention is shown in FIG. 4, and parts similar to those described with reference to FIG. 1 are identified by the same reference numerals.

The jaw pick-up region $J_P$ located beneath the anvils 20 of the yarn carrier 30 is adapted to constrain the yarn tail $Y_T$ against lateral deflection in the longitudinal direction of the carrier body 12.

This is achieved by means of yarn guides 32 located beneath the anvils 20 to define opposed sides of the yarn guide passageway 14 in the jaw pick-up region $J_P$.

Each of the yarn guides 32 includes a guide portion 34 corresponding in width to the bottom of the anvils 20 and a narrower leg portion 36 protruding from the guide portion 34 towards the associated anvil 20.

Each of the anvils 20 is formed from two spaced apart bridging plates 38,40 to define a hollow interior 42 in which the leg portion 36 of an associated yarn guide 32 is slidably received.

The yarn brake 24 is mounted on the bridging plates 38,40 and thereby closes the open top of the anvil 20.

A compression spring 44 is provided in the hollow interior 42 of the anvil 20 between the yarn brake 24 closing the top of the hollow interior 42 and the leg portion 36 of the associated yarn guide 32. The leg portion 36 of the yarn guide 32 is thereby biased outwardly of the hollow interior 42 of the anvil 20 to maintain the guide portion 34 in alignment with the open bottom of the carrier body 12. In this position, the guide portion 34 is spaced from the open bottom of the anvil 20.

The end of the leg portion 36 in contact with the compression spring 44 is preferably shaped to define a finger 46 slidably received within the interior of the compression spring 44 to maintain engagement therewith.

The guide portion 34 of each yarn guide 32 is preferably shaped to slope outwards away from the leg portion 36, towards the adjacent yarn guide passageway 14. The guide portions 34 thereby provide sloping shoulders on opposed sides of the yarn guide passageway 14 in the jaw pick-up region $J_P$.

The depth of the guide portion 34 of each yarn guide 32 is preferably chosen to correspond to the distance D between the internal faces 18*a* of the plates 18 of the carrier body 12 (as shown in FIG. 5) to ensure that any lateral deflection longitudinally of the carrier body 12 is prevented.

The yarn brake 24 is preferably adapted to be slidably received over the bridging plates 38,40 of each anvil 20, and is preferably from a length of resilient spring material folded to define first and second limbs 24*a*,24*b*.

The first limb 24*a* of the yarn brake 24 preferably extends across the passageway 14 on one side of the anvil 20 to abuttingly engage the opposed side face 20*a* of the neighboring anvil 20. The first limb 24*a* thereby ensures that the yarn 16 is only able to pass longitudinally in one direction and is held in place when not being drawn.

The second limb 24*b* of the yarn brake 24 preferably extends across the passageway 14 on the other side of the anvil 20, towards the bottom of the opposed side face 20*a* of the other neighboring anvil 20.

The second limb 24*b* thereby provides a guide on which the yarn 16, trapped between the first limb 24*a* of the neighboring yarn brake 24 and the side face 20*a* of the anvil 20, is guided towards the opposed side face 20*a* of the neighboring anvil 20 to hold the yarn 16 against the opposed side face 20*a* of the neighboring anvil 20 just above the jaw pick-up region $J_P$. In this way, the yarn tail $Y_T$ of the yarn 16 lies against the shoulder defined by the guide portion 34 of the yarn guide 32 located below the neighboring anvil 20.

Preferably, the yarn trap 24 is shaped to extend above the anvil 20 as it is bent over to define the first limb 24*a*. This extension improves the resilience of the first limb 24*a* to ensure that it pushes against the opposed side face 20*a* of the neighboring anvil 20.

Preferably, the yarn trap 24 engages against the bottom edge of the bridging plate 40 towards which the second limb 24*b* of a neighboring yarn trap 24 pushes the yarn 16. The yarn trap 24 thereby defines a stop 25.

Figure 6:
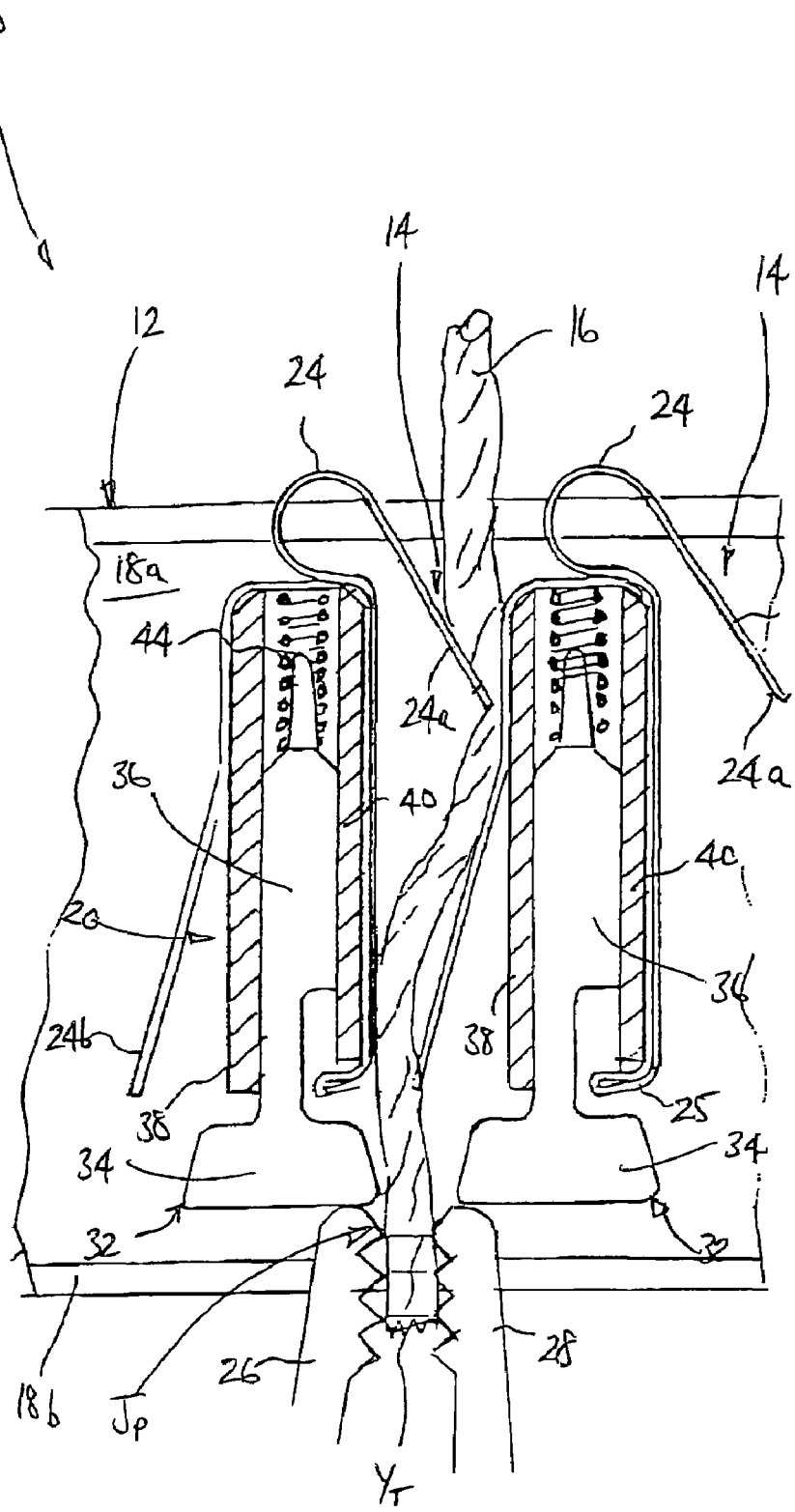
FIG. 6 shows a partial, broken away, side view of the yarn carrier of FIG. 4 during a yarn pick up operation.

When the gripper moves to pick up the yarn tail $Y_T$, the terminal ends of the gripper jaws 26,28 contact the guide portions 34 of the yarns guides 32 located on opposed sides of the yarn guide passageway 14 in the jaw pick-up region $J_P$. Continued upward movement of the terminal ends of the gripper jaws 36,38 pushes the guide portions 34 upwards towards the associated anvils 20 (as shown in FIG. 6), causing movement of the associated leg portions 36 into the hollow interiors 42 of the anvils 20 against the spring bias provided by the compression springs 44.

During this upwards movement of the guide portions 34, the shoulder defined by the guide portion 34, against which the yarn tail $Y_T$ is constrained by the second limb 24*b* of the yarn brake 24, remains in contact with the yarn tail $Y_T$ and prevents lateral deflection in the longitudinal direction of the carrier body 12. The yarn tail $Y_T$ is thereby guided between the open gripper jaws 26,28 so that, when the gripper jaws 26,28 close, the yarn tail $Y_T$ is gripped by the gripper jaws 26,28.

The spring bias provided by the compression springs 44 within the hollow interiors 42 of the anvils 20 is such that the leg portions 36 of the yarn guides 32 are pushed outwardly of the hollow interiors 42 when the gripper jaws 26,28 move out of contact with the guide portions 34. The guide portions 34 are thereby repositioned in alignment with the open bottom of the carrier body 12.

When the yarn carrier 30 of the present invention is used in an Axminster gripper loom, a plurality of yarns 16 are held in the yarn carrier 30 for the purposes of selectively presenting the yarns 16 to a pair of gripper jaws 26,28.

A yarn 16 is inserted into a yarn inlet end of each of the longitudinally spaced yarn guide passageways 14 of the yarn carrier 30, and is guided along the yarn guide passageway 14 to present a yarn tail $Y_T$ at the yarn outlet end, otherwise referred to as the jaw pick-up region $J_P$, of the yarn guide passageway 14.

In the jaw pick-up region $J_P$ of each of the yarn guide passageways 14, the respective yarn tail $Y_T$ is constrained against lateral deflection to assist pick-up of the yarn tail $Y_T$ when it is presented to a pair of gripper jaws 26,28 during operation of the loom.

During operation of such a loom to weave a carpet, a plurality of the yarns carriers 30 are used to hold pluralities of yarns 16 for selective presentation to pluralities of pairs of gripper jaws 26,28.

Each of the yarn carriers 30 is selectively moved to present a chosen yarn 16 to a respective pair of the gripper jaws 26,28, which are then operated to pick-up the yarn tail $Y_T$ of the chosen yarn 16 and withdraw a predetermined length of the chosen yarn 16 from the respective yarn carrier 30.

The chosen yarns 16 are then cut such that each pair of gripper jaws 26,28 holds a tuft of yarn 16, each pair of gripper jaws 26,28 then being operated to transfer the tufts of yarn 16 to weaving positions in the carpet where each tuft of yarn 16 is secured in position in the carpet by a weaving process.

This invention has been described herein in considerable detail in order to comply with the patent statutes and to provide those skilled in the art with the information needed to apply the novel principles and to construct and use such specialized components as are required. However, it is to be understood that the invention can be carried out by specifically different equipment and devices, and that various modifications, both as to the equipment and operating procedures, can be accomplished without departing from the scope of the invention itself.

What is claimed is:

1. A yarn carrier for presenting a selected yarn to a pair of gripper jaws, the yarn carrier including a yarn guide passageway defining a path along which the selected yarn is longitudinally guided, the passageway having a yarn inlet end, a yarn outlet end and adjacent to the yarn outlet end yarn guides to constrain the tail of the yarn against lateral deflection in a longitudinal direction of the yarn carrier, the yarn guides moving from an extended position to a depressed position on contact with open gripper jaws, and each of the yarn guides comprising with a biasing member to bias the yarn guide from its depressed position towards its extended position to enable the gripper jaws to grip the yarn tail.

2. A yarn carrier according to claim 1 wherein each yarn guide includes a guide portion mounted on a narrower leg portion, which is slidably received within a hollow anvil member, the hollow anvil member housing a compression spring between the bottom of the hollow interior of the anvil member and the bottom of the leg portion to bias the yarn guide towards its extended position in which the guide portion is located adjacent the yarn outlet end.

3. A yarn carrier according to claim 2 wherein the end of the leg portion of each yarn guide, in contact with the compression spring, is shaped to define a finger slidably received within the interior of the compression spring.

4. A yarn carrier according to claim 2 wherein the guide portion of each yarn guide is shaped to slope outwards away from the respective leg portion towards the yarn guide passageway such that an adjacent pair of yarn guides provide sloping shoulders on opposed sides of the yarn guide passageway.

5. A yarn carrier according to claim 3 wherein the guide portion of each yarn guide is shaped to slope outwards away from the respective leg portion towards the yarn guide passageway such that an adjacent pair of yarn guides provide sloping shoulders on opposed sides of the yarn guide passageway.

6. An Axminster gripper loom incorporating a yarn carrier according to any one of the preceding claims.

* * * * *

UNITED STATES PATENT AND TRADEMARK OFFICE

CERTIFICATE OF CORRECTION

PATENT NO. : 7,392,829 B2
APPLICATION NO. : 11/361211
DATED : July 1, 2008
INVENTOR(S) : John Dalton Griffith It is certified that error appears in the above-identified patent and that said Letters Patent is hereby corrected as shown below:

Column 6, line 8, delete “with”.

Signed and Sealed this

Twenty-sixth Day of August, 2008

JON W. DUDAS
*Director of the United States Patent and Trademark Office*